US006112816A

United States Patent [19]

Orzechowski et al.

[11] Patent Number: 6,112,816

[45] Date of Patent: Sep. 5, 2000

[54] SINGLE-PHASE ANNULUS-OPERATED SLIDING SLEEVE

[75] Inventors: Diana L. Orzechowski, Pearland; Billy R. Newman, Houston, both of Tex.

[73] Assignee: Camco International Inc., Houston, Tex.

[21] Appl. No.: 09/113,764

[22] Filed: Jul. 10, 1998

Related U.S. Application Data

[60] Provisional application No. 60/052,114, Jul. 10, 1997.

[51] Int. Cl.[7] ..... E21B 34/00

[52] U.S. Cl. ..... 166/324; 166/332.4; 166/332.7; 166/334.4

[58] Field of Search ..... 166/319, 321, 166/324, 332.4, 332.7, 334.4, 334.1, 383

[56] References Cited

U.S. PATENT DOCUMENTS

| | | | |
|---|---|---|---|
| 3,874,634 | 4/1975 | Gazda | 166/322 X |
| 3,990,511 | 11/1976 | Gazda | 166/322 |
| 4,043,392 | 8/1977 | Gazda | 166/217 |
| 4,429,747 | 2/1984 | Williamson, Jr. . | |
| 4,434,854 | 3/1984 | Vann et al. . | |
| 4,917,191 | 4/1990 | Hopmann et al. . | |
| 4,942,926 | 7/1990 | Lessi . | |
| 5,211,241 | 5/1993 | Mashaw, Jr. et al. . | |
| 5,309,988 | 5/1994 | Shy et al. . | |
| 5,316,084 | 5/1994 | Murray et al. . | |
| 5,355,953 | 10/1994 | Shy et al. . | |
| 5,479,989 | 1/1996 | Shy et al. . | |

FOREIGN PATENT DOCUMENTS 0 452 033 A2 10/1991 European Pat. Off. .

*Primary Examiner*—Roger Schoeppel
*Attorney, Agent, or Firm*—Tabor, Goldstein & Healey

[57] ABSTRACT

A sliding sleeve is provided to control the flow of fluids through a tubular conduit. The sliding sleeve may include a housing having a longitudinal bore, at least one annulus pressure port, and at least one fluid flow port. An inner sleeve is disposed for axial movement within the longitudinal bore of the housing, and includes at least one fluid flow port for sealably cooperating with the fluid flow port in the housing to control the flow of fluids through the tubing string. A piston is associated with the inner sleeve and the housing. The piston is initially releasably secured to the housing. The sliding sleeve is initially provided with the fluid flow ports in a closed position, and is actuated by applying annulus pressure to the piston through the at least one annulus pressure port in the housing. The annulus pressure releases the piston from the housing and forces the piston and inner sleeve upwardly to establish fluid communication through the fluid flow ports.

51 Claims, 9 Drawing Sheets

SINGLE-PHASE ANNULUS-OPERATED SLIDING SLEEVE

RELATED APPLICATIONS

This application claims the benefit of U.S. Provisional Application No. 60/052,114, filed Jul. 10, 1997.

BACKGROUND OF THE INVENTION

1. Field of the Invention

The present invention relates to well completion equipment, and more specifically to mechanisms for controlling the flow of fluids within a well bore.

2. Description of the Related Art

It is known that after an oil and gas well has been drilled it is completed by lining it with a string of casing that is cemented in place and then perforated adjacent a production zone containing hydrocarbon fluids. The hydrocarbon fluids flow through the casing perforations and into a tubing string positioned within the casing. The tubing string and the casing form an annulus therebetween. It is also known that a well tool that can be selectively opened and closed, commonly known as a "sliding sleeve," may be connected in series with the tubing string to control fluid flow therethrough. The sliding sleeve may be used to control the flow of hydrocarbon fluids from the production zone to the earth's surface, or it can be used to control the flow of various fluids for stimulating or working a well from the earth's surface through the tubing string into the well annulus. Sliding sleeves are generally controlled from the earth's surface by wireline tools, or by other mechanisms known to those of skill in the art. A need has arisen in the industry for a sliding sleeve that may be initially actuated without the use of wireline tools. It has been appreciated that the ability to initially actuate the sliding sleeve without making a trip into the well with wireline tools will result in savings of valuable time and labor. The present invention has been developed in response to this need, and meets this need by providing a sliding sleeve that is initially actuated by annulus pressure instead of by the use of wireline or other tools.

SUMMARY OF THE INVENTION

The present invention has been contemplated to meet the above-described needs. The present invention is a sliding sleeve connected to a tubular conduit disposed within a well conduit for controlling fluid flow through the tubular conduit, the tubular conduit and well conduit defining an annulus therebetween. In one aspect, the sliding sleeve includes: a housing having a longitudinal bore extending therethrough, at least one annulus pressure port, and at least one outer fluid flow port; an inner sleeve disposed for axial movement within the longitudinal bore of the housing, and having a longitudinal bore and at least one inner fluid flow port for cooperating with the at least one outer fluid flow port through the housing to control fluid flow between the annulus and the longitudinal bore of the inner sleeve; and, a piston associated with the inner sleeve and the longitudinal bore of the housing. The housing, inner sleeve, and piston cooperate to yield: a run-in mode wherein the piston is releasably secured to the housing, the piston is exposed to annulus pressure through the at least one annulus pressure port, and the at least one outer fluid flow port is misaligned with the at least one inner fluid flow port so that fluid communication is prevented between the annulus and the longitudinal bore of the inner sleeve; an opening mode wherein a predetermined annulus pressure is applied through the at least one annulus pressure port to the piston to release the piston from the housing and force the inner sleeve to a first position so that the at least one outer fluid flow port is aligned with the at least one inner fluid flow port and fluid communication is established between the annulus and the longitudinal bore of the inner sleeve; and, a closing mode wherein the inner sleeve is shifted to a second position so that the at least one outer fluid flow port is misaligned with the at least one inner fluid flow port so that fluid communication is prevented between the annulus and the longitudinal bore of the inner sleeve.

Another feature of the present invention is that the sliding sleeve may further include a collet attached to the inner sleeve and having an annular rib. Another feature of the present invention is that the housing further includes at least one annular recess within its longitudinal bore for receiving the collet rib. Another feature of the present invention is that: the housing further includes within its longitudinal bore an upper annular recess, an intermediate annular recess, and a lower annular recess; and, the collet rib is located in the upper annular recess when the inner sleeve is in its first position, the collet rib is located in the intermediate annular recess when the inner sleeve is in the run-in mode, and the collet rib is located in the lower annular recess when the inner sleeve is in its second position. Another feature of the present invention is that the predetermined annulus pressure is sufficient to release the piston from the housing and disengage the collet rib from the intermediate recess. Another feature of the present invention is that the sliding sleeve may further include piston seal means for sealing the piston from the at least one annulus pressure port so that the piston is no longer exposed to annulus pressure when the inner sleeve is in its second position. Another feature of the present invention is that the piston seal means includes an outer upper annular piston seal and an outer lower annular piston seal, the outer annular seals being disposed between the piston and the housing, the outer upper annular seal being disposed above the at least one annulus pressure port when the inner sleeve is in its second position, and the outer lower annular seal being disposed below the at least one annulus pressure port when the inner sleeve is in its second position. Another feature of the present invention is that the outer annular seals are disposed above the at least one annulus pressure port when the sliding sleeve is in its run-in mode. Another feature of the present invention is that an upper surface of the piston is abutted against an upper shoulder of the inner sleeve when the sliding sleeve is in its run-in mode, and a lower surface of the piston is displaced above an annular shoulder within the longitudinal bore of the housing when the sliding sleeve is in its run-in mode. Another feature of the present invention is that an upper surface of the piston is abutted against an upper shoulder of the inner sleeve when the inner sleeve is in its second position, and a lower surface of the piston is abutted against an annular shoulder within the longitudinal bore of the housing when the inner sleeve is in its second position. Another feature of the present invention is that an upper surface of the inner sleeve is abutted against an upper annular shoulder within the longitudinal bore of the housing when the inner sleeve is in its first position.

Another feature of the present invention is that the sliding sleeve may further include an upper annular flow port seal and a lower annular flow port seal, the flow port seals being disposed between the inner sleeve and the housing, the upper annular flow port seal being disposed above the outer fluid flow port and the lower annular flow port seal being disposed below the outer fluid flow port. Another feature of the present invention is that the flow port seals are chevron packing. Another feature of the present invention is that fluid communication between the annulus and the longitudinal bore of the inner sleeve becomes sealably prevented upon the at least one inner fluid flow port in the inner sleeve passing below the lower annular flow port seal during transition from the opening mode to the closing mode. Another feature of the present invention is that the sliding sleeve may further include an inner annular piston seal disposed between the inner sleeve and the piston, an outer annular piston seal disposed between the piston and the housing, and an upper annular flow port seal disposed above the outer fluid flow port and between the inner sleeve and the housing, whereby the inner annular piston seal, the outer annular piston seal, and the upper annular flow port seal cooperate to sealably apply annulus pressure to the piston. Another feature of the present invention is that the piston is sealably disposed around the inner sleeve and within the longitudinal bore of the housing. Another feature of the present invention is that the piston is shearably affixed by shear means to the housing during the run-in mode. Another feature of the present invention is that the sliding sleeve may further include an annular housing seal disposed within the longitudinal bore of the housing beneath the shear means and above an annular shoulder within the housing to prevent any leakage associated with the shear means when the inner sleeve is in its second position. Another feature of the present invention is that the inner sleeve further includes at least one equalizing port above the at least one inner fluid flow port; the housing further includes within its longitudinal bore an equalizing recess between the upper recess and the intermediate recess; and the housing and inner sleeve cooperate to yield an equalizing mode wherein the collet rib is located in the equalizing recess, and pressure between the annulus and the longitudinal bore of the inner sleeve is equalized through the equalizing port and outer fluid flow port.

In another aspect of the present invention, the sliding sleeve includes: a housing having a longitudinal bore extending therethrough, at least one annulus pressure port, and at least one outer fluid flow port, the longitudinal bore having an upper annular recess, an intermediate annular recess, and a lower annular recess; an inner sleeve disposed for axial movement within the longitudinal bore of the housing, and having a longitudinal bore and at least one inner fluid flow port for cooperating with the at least one outer fluid flow port through the housing to control fluid flow between the annulus and the longitudinal bore of the inner sleeve; a piston associated with the inner sleeve and the longitudinal bore of the housing; a collet attached to the inner sleeve and having an annular rib. In this aspect, the housing, inner sleeve, and piston cooperate to yield: a run-in mode wherein the piston is releasably secured to the housing, the piston is exposed to annulus pressure through the at least one annulus pressure port, the at least one outer fluid flow port is misaligned with the at least one inner fluid flow port so that fluid communication is prevented between the annulus and the longitudinal bore of the inner sleeve, and the collet rib is located in the intermediate annular recess; an opening mode wherein a predetermined annulus pressure is applied through the at least one annulus pressure port to the piston to release the piston from the housing, disengage the collet rib from the intermediate recess, and force the inner sleeve to a first position, so that the at least one outer fluid flow port is aligned with the at least one inner fluid flow port, fluid communication is established between the annulus and the longitudinal bore of the inner sleeve, and the collet rib is located in the upper annular recess; and, a closing mode wherein the inner sleeve is shifted to a second position so that the at least one outer fluid flow port is misaligned with the at least one inner fluid flow port, fluid communication is prevented between the annulus and the longitudinal bore of the inner sleeve, and the collet rib is located in the lower annular recess.

Another feature of the present invention is that the sliding sleeve may further include an outer upper annular piston seal and an outer lower annular piston seal, the outer annular seals being disposed between the piston and the housing, the outer upper annular seal being disposed above the at least one annulus pressure port when the inner sleeve is in its second position, and the outer lower annular seal being disposed below the at least one annulus pressure port when the inner sleeve is in its second position, the outer piston seals sealing the piston from the at least one annulus pressure port so that the piston is no longer exposed to annulus pressure when the inner sleeve is in its second position. Another feature of the present invention is that the outer annular seals are disposed above the at least one annulus pressure port when the sliding sleeve is in its run-in mode. Another feature of the present invention is that: when the sliding sleeve is in its run-in mode, an upper surface of the piston is abutted against an upper shoulder of the inner sleeve, and a lower surface of the piston is displaced above an annular shoulder within the longitudinal bore of the housing; when the inner sleeve is in its second position, the upper surface of the piston is abutted against the upper shoulder of the inner sleeve, and the lower surface of the piston is abutted against the annular shoulder within the longitudinal bore of the housing; and, when the inner sleeve is in its second position, an upper surface of the inner sleeve is abutted against an upper annular shoulder within the longitudinal bore of the housing.

Another feature of the present invention is that the sliding sleeve may further include an upper annular flow port seal and a lower annular flow port seal, the flow port seals being disposed between the inner sleeve and the housing, the upper annular flow port seal being disposed above the outer fluid flow port and the lower annular flow port seal being disposed below the outer fluid flow port. Another feature of the present invention is that the flow port seals are chevron packing. Another feature of the present invention is that fluid communication between the annulus and the longitudinal bore of the inner sleeve becomes sealably prevented upon the at least one inner fluid flow port in the inner sleeve passing below the lower annular flow port seal during transition from the opening mode to the closing mode. Another feature of the present invention is that the sliding sleeve may further include an inner annular piston seal disposed between the inner sleeve and the piston, an outer lower annular piston seal disposed between the piston and the housing, and an upper annular flow port seal disposed above the outer fluid flow port and between the inner sleeve and the housing, whereby the inner annular piston seal, the outer lower annular piston seal, and the upper annular flow port seal cooperate to sealably apply annulus pressure to the piston. Another feature of the present invention is that the piston is sealably disposed around the inner sleeve and within the longitudinal bore of the housing. Another feature of the present invention is that the piston is shearably affixed by shear means to the housing during the run-in mode. Another feature of the present invention is that the sliding sleeve may further include an annular housing seal disposed within the longitudinal bore of the housing beneath the shear means and above an annular shoulder within the housing to prevent any leakage associated with the shear means when the inner sleeve is in its second position. Another feature of the present invention is that: the inner sleeve further includes at least one equalizing port above the at least one inner fluid flow port; the housing further includes within its longitudinal bore an equalizing recess between the upper recess and the intermediate recess; and the housing and inner sleeve cooperate to yield an equalizing mode wherein the collet rib is located in the equalizing recess, and pressure between the annulus and the longitudinal bore of the inner sleeve is equalized through the equalizing port and outer fluid flow port.

In yet another aspect of the present invention, the sliding sleeve includes a housing having a longitudinal bore extending therethrough, at least one annulus pressure port, and at least one outer fluid flow port; an inner sleeve disposed for axial movement within the longitudinal bore of the housing, and having a longitudinal bore and at least one inner fluid flow port for cooperating with the at least one outer fluid flow port through the housing to control fluid flow between the annulus and the longitudinal bore of the inner sleeve; and, a piston associated with the inner sleeve and the longitudinal bore of the housing. In this aspect, the housing, inner sleeve, and piston cooperate to yield: a run-in mode wherein the piston is exposed to annulus pressure through the at least one annulus pressure port, and the at least one outer fluid flow port is misaligned with the at least one inner fluid flow port so that fluid communication is prevented between the annulus and the longitudinal bore of the inner sleeve; an opening mode wherein a predetermined annulus pressure is applied through the at least one annulus pressure port to the piston to force the inner sleeve to a first position so that the at least one outer fluid flow port is aligned with the at least one inner fluid flow port and fluid communication is established between the annulus and the longitudinal bore of the inner sleeve; and, a closing mode wherein the inner sleeve is shifted to a second position so that the at least one outer fluid flow port is misaligned with the at least one inner fluid flow port so that fluid communication is prevented between the annulus and the longitudinal bore of the inner sleeve. Another feature of the present invention is that the piston is releasably secured to the housing during the run-in mode, and the predetermined annulus pressure releases the piston from the housing during the opening mode. Another feature of the present invention is that the sliding sleeve may further include a collet attached to the inner sleeve and having an annular rib. Another feature of the present invention is that the housing further includes at least one annular recess within its longitudinal bore for receiving the collet rib. Another feature of the present invention is that: the housing further includes within its longitudinal bore an upper annular recess, an intermediate annular recess, and a lower annular recess; and, the collet rib is located in the upper annular recess when the inner sleeve is in its first position, the collet rib is located in the intermediate annular recess when the inner sleeve is in the run-in mode, and the collet rib is located in the lower annular recess when the inner sleeve is in its second position. Another feature of the present invention is that the predetermined annulus pressure is sufficient to disengage the collet rib from the intermediate recess during the run-in mode.

Another feature of the present invention is that the sliding sleeve may further include piston seal means for sealing the piston from the at least one annulus pressure port so that the piston is no longer exposed to annulus pressure when the inner sleeve is in its second position. Another feature of the present invention is that the piston seal means includes an outer upper annular piston seal and an outer lower annular piston seal, the outer annular seals being disposed between the piston and the housing, the outer upper annular seal being disposed above the at least one annulus pressure port when the inner sleeve is in its second position, and the outer lower annular seal being disposed below the at least one annulus pressure port when the inner sleeve is in its second position. Another feature of the present invention is that the outer annular seals are disposed above the at least one annulus pressure port when the sliding sleeve is in its run-in mode. Another feature of the present invention is that an upper surface of the piston is abutted against an upper shoulder of the inner sleeve when the sliding sleeve is in its run-in mode, and a lower surface of the piston is displaced above an annular shoulder within the longitudinal bore of the housing when the sliding sleeve is in its run-in mode. Another feature of the present invention is that an upper surface of the piston is abutted against an upper shoulder of the inner sleeve when the inner sleeve is in its second position, and a lower surface of the piston is abutted against an annular shoulder within the longitudinal bore of the housing when the inner sleeve is in its second position. Another feature of the present invention is that an upper surface of the inner sleeve is abutted against an upper annular shoulder within the longitudinal bore of the housing when the inner sleeve is in its first position.

Another feature of the present invention is that the sliding sleeve may further include an upper annular flow port seal and a lower annular flow port seal, the flow port seals being disposed between the inner sleeve and the housing, the upper annular flow port seal being disposed above the outer fluid flow port and the lower annular flow port seal being disposed below the outer fluid flow port. Another feature of the present invention is that the flow port seals are chevron packing. Another feature of the present invention is that fluid communication between the annulus and the longitudinal bore of the inner sleeve becomes sealably prevented upon the at least one inner fluid flow port in the inner sleeve passing below the lower annular flow port seal during transition from the opening mode to the closing mode. Another feature of the present invention is that the sliding sleeve may further include an inner annular piston seal disposed between the inner sleeve and the piston, an outer annular piston seal disposed between the piston and the housing, and an upper annular flow port seal disposed above the outer fluid flow port and between the inner sleeve and the housing, whereby the inner annular piston seal, the outer annular piston seal, and the upper annular flow port seal cooperate to sealably apply annulus pressure to the piston. Another feature of the present invention is that the piston is sealably disposed around the inner sleeve and within the longitudinal bore of the housing. Another feature of the present invention is that the piston is shearably affixed by shear means to the housing during the run-in mode. Another feature of the present invention is that the sliding sleeve may further include an annular housing seal disposed within the longitudinal bore of the housing beneath the shear means and above an annular shoulder within the housing to prevent any leakage associated with the shear means when the inner sleeve is in its second position. Another feature of the present invention is that: the inner sleeve further includes at least one equalizing port above the at least one inner fluid flow port; the housing further includes within its longitudinal bore an equalizing recess between the upper recess and the intermediate recess; and the housing and inner sleeve cooperate to yield an equalizing mode wherein the collet rib is located in the equalizing recess, and pressure between the annulus and the longitudinal bore of the inner sleeve is equalized through the equalizing port and outer fluid flow port.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
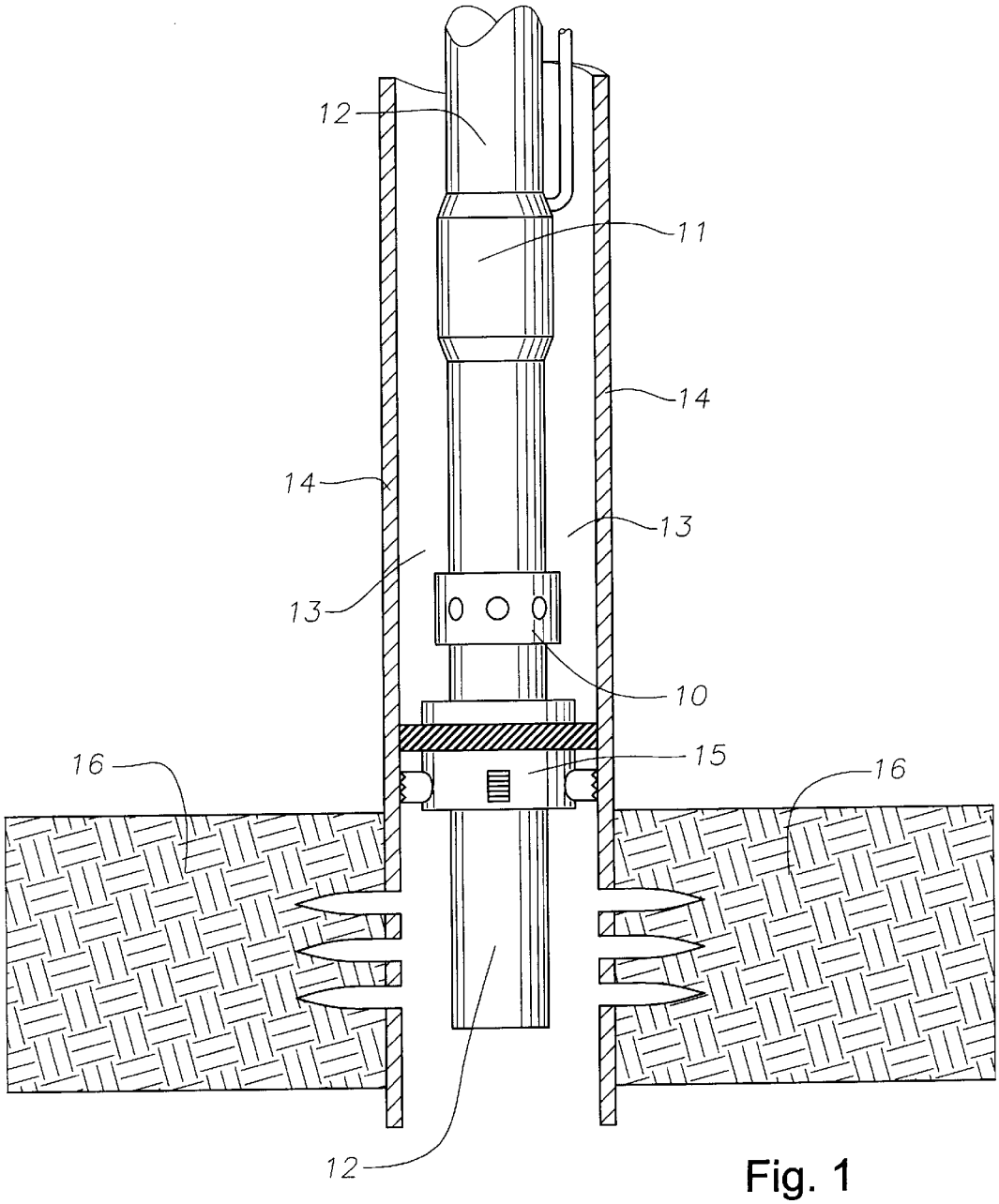
FIG. 1 illustrates a partial cross-sectional elevation view of a sliding sleeve of the present invention serially connected to a tubing string disposed within a well conduit.

Referring to the drawings in detail, wherein like numerals denote identical elements throughout the several views, there is shown in FIG. 1 a sliding sleeve 10 that is serially connected to a tubular conduit 12, such as a tubing string or coiled tubing, disposed within a well conduit or casing 14 for controlling fluid flow through the tubular conduit 12. The tubular conduit 12 and the casing 14 define an annulus 13 therebetween. As explained above, the sliding sleeve 10 may be used to control the flow of hydrocarbon fluids from a production zone 16 to the earth's surface (not shown), or it can be used to circulate various fluids from the earth's surface through the tubular conduit 12 and into the well annulus 13 to stimulate or work the well, as known to those of skill in the art. FIG. 1 illustrates a well completion wherein the sliding sleeve 10 is to be used in a fluid circulating mode. This well completion is also shown with a subsurface safety valve 11 and a packer 15.

Figure 2A:
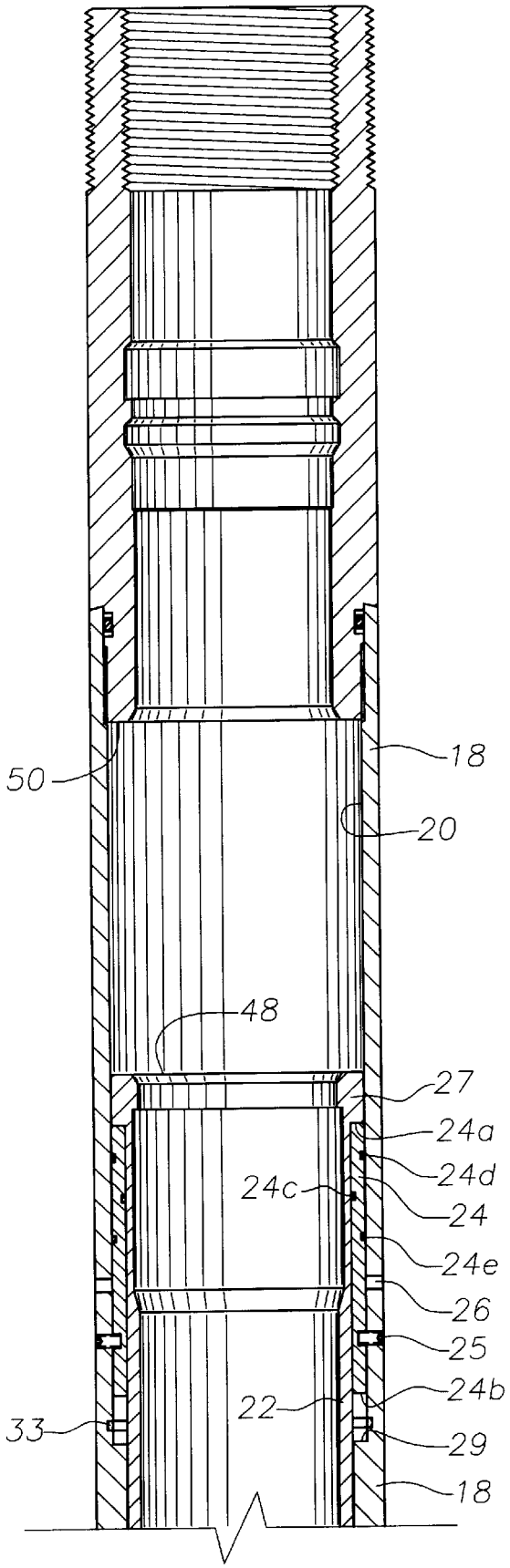
FIGS. 2A through 2C illustrate a partial cross-sectional elevation view which together show a sliding sleeve of the present invention in a run-in position.
Figure 2B:
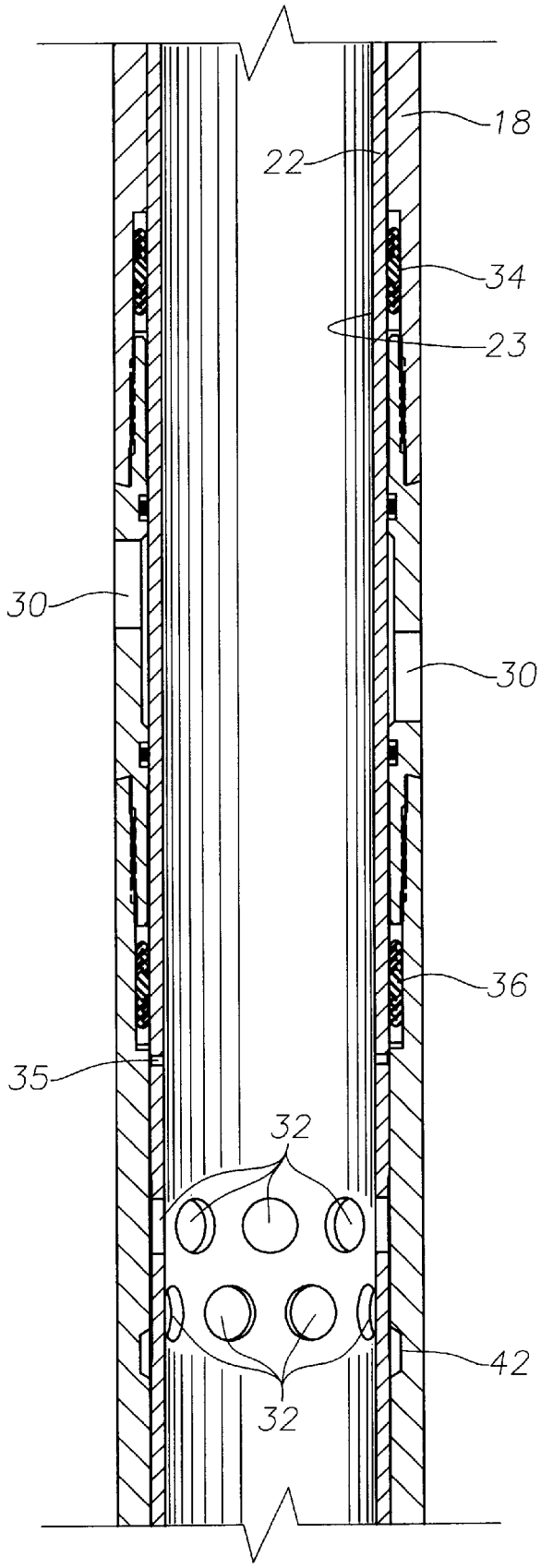
Figure 2C:
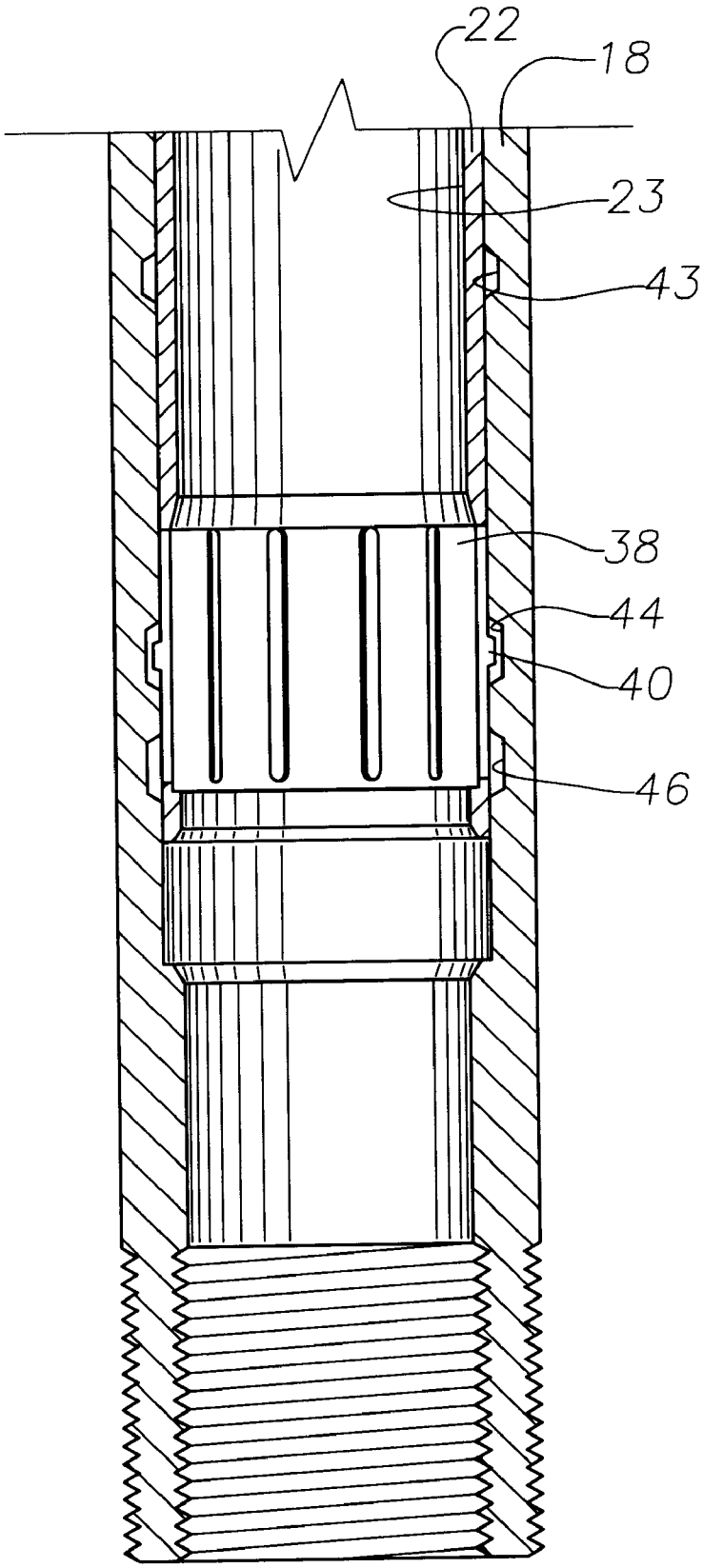

FIGS. 2A–2C illustrate the sliding sleeve 10 in its initial or run-in configuration. Referring to FIG. 2A, in a specific embodiment, the sliding sleeve 10 of the present invention includes a housing 18 having a longitudinal bore 20 extending therethrough. An inner sleeve 22 is disposed for axial movement within the longitudinal bore 20. A piston 24 is associated with the inner sleeve 22 and the longitudinal bore. In a specific embodiment, the piston 24 may be sealably disposed around the inner sleeve 22 and within the longitudinal bore 20 of the housing 18. The piston 24 is provided with an upper surface 24*a*, a lower surface 24*b*, an inner annular piston seal 24*c*, an outer upper annular piston seal 24*d*, and an outer lower annular piston seal 24*e*. The inner annular piston seal 24*c* is disposed between the inner sleeve 22 and the piston 24. The outer annular piston seals 24*d* and 24*e* are disposed between the piston 24 and the housing 18. At least one annulus pressure port 26 is provided through the housing 18 for exposing the piston 24 to pressure within an annulus 13 (FIG. 1) between the tubular conduit 12 and the casing 14. During the run-in mode, as shown in FIG. 2A, and before the sliding sleeve is first actuated: the piston 24 is releasably secured to the housing 18, for example, by at least one shear pin 25; the upper surface 24*a* of the piston 24 is abutted against an upper shoulder 27 of the inner sleeve 22; the lower surface 24*b* of the piston is displaced above an annular shoulder 29 within the longitudinal bore 20 of the housing 18; and the outer annular seals 24*d* and 24*e* are located above the at least one annulus pressure port 26. The housing may also be provided with an annular housing seal 33 beneath the at least one shear pin 25 and above the annular shoulder 29. The function of the housing seal 33 will be explained below.

Referring now to FIG. 2B, the housing 18 is provided with at least one outer fluid flow port 30, and the inner sleeve 22 is provided with at least one inner fluid flow port 32. An upper annular flow port seal 34 is disposed above the at least one outer fluid flow port 30 and between the housing 18 and the inner sleeve 22. Similarly, a lower annular flow port seal 34 is disposed below the at least one outer fluid flow port 30 and between the housing 18 and the inner sleeve 22. In a specific embodiment, the flow port seals 34 and 36 may be chevron packing, as well known to those of skill in the art. As will be more fully explained below, the at least one outer fluid flow port 30 and the at least one inner fluid flow port 32 sealably cooperate to control fluid flow between the annulus 13 (FIG. 1) and a longitudinal bore 23 through the inner sleeve 22. FIG. 2B illustrates the fluid flow ports 30 and 32 in a closed or non-aligned relationship. In this position, fluid flow from the annulus 13 is prevented from flowing into the longitudinal bore 23 of the inner sleeve 22. Further, the upper and lower annular seals 34 and 36 prevent fluid from migrating upwardly or downwardly in the annular space between the housing 18 and the inner sleeve 22. The inner sleeve 22 may also be provided with at least one equalizing port 35 above the at least one flow port 32. The function of the at least one equalizing port 35 will be explained below.

As shown in FIG. 2C, the lower end of the inner sleeve 22 is provided with a collet 38 having an annular rib 40. The longitudinal bore 20 through the housing 18 is provided with a number of annular recesses for receiving the collet rib 40. In a specific embodiment, the bore 20 may be provided with an upper annular recess 42, an intermediate annular recess 44, and a lower annular recess 46. In another embodiment, the bore 20 may also be provided with an equalizing recess 43 between the upper recess 42 and the intermediate recess 44. The collet rib 40 is located in the intermediate recess 44 when the sliding sleeve 10 is in its run-in mode, as shown in FIGS. 2A–2C. The relationship between the collet rib 40 and the upper, equalizing, and lower recesses 42, 43, and 46 will be described below.

Figure 3A:
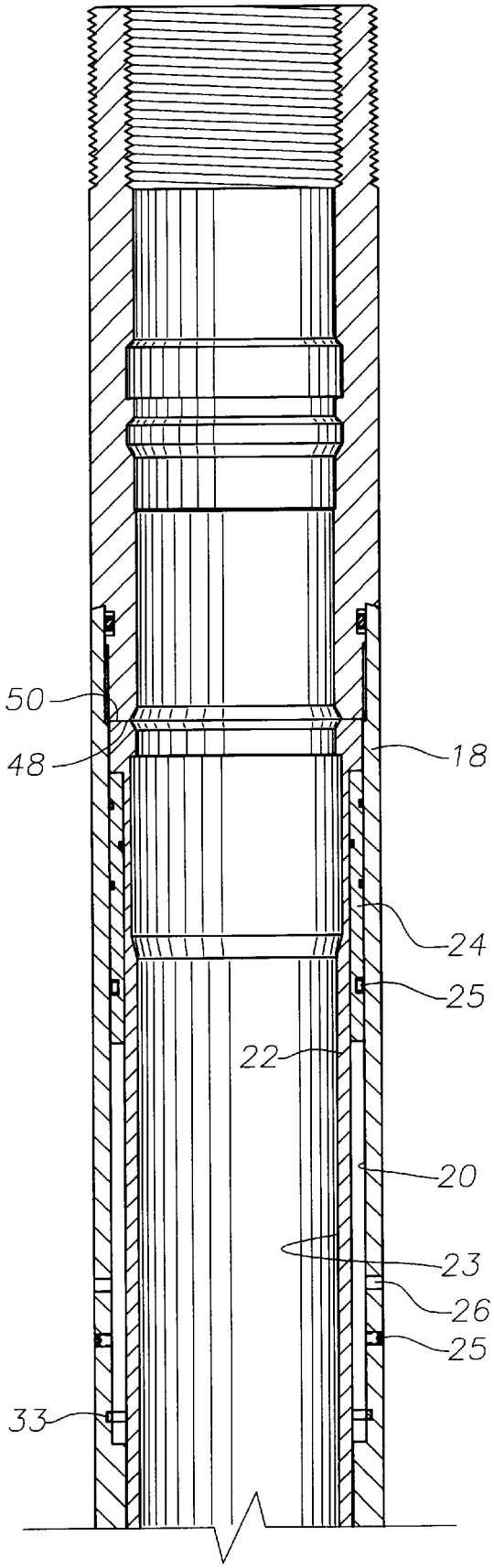
FIGS. 3A through 3B illustrate a partial cross-sectional elevation view which together show a sliding sleeve of the present invention in an open position.
Figure 3B:
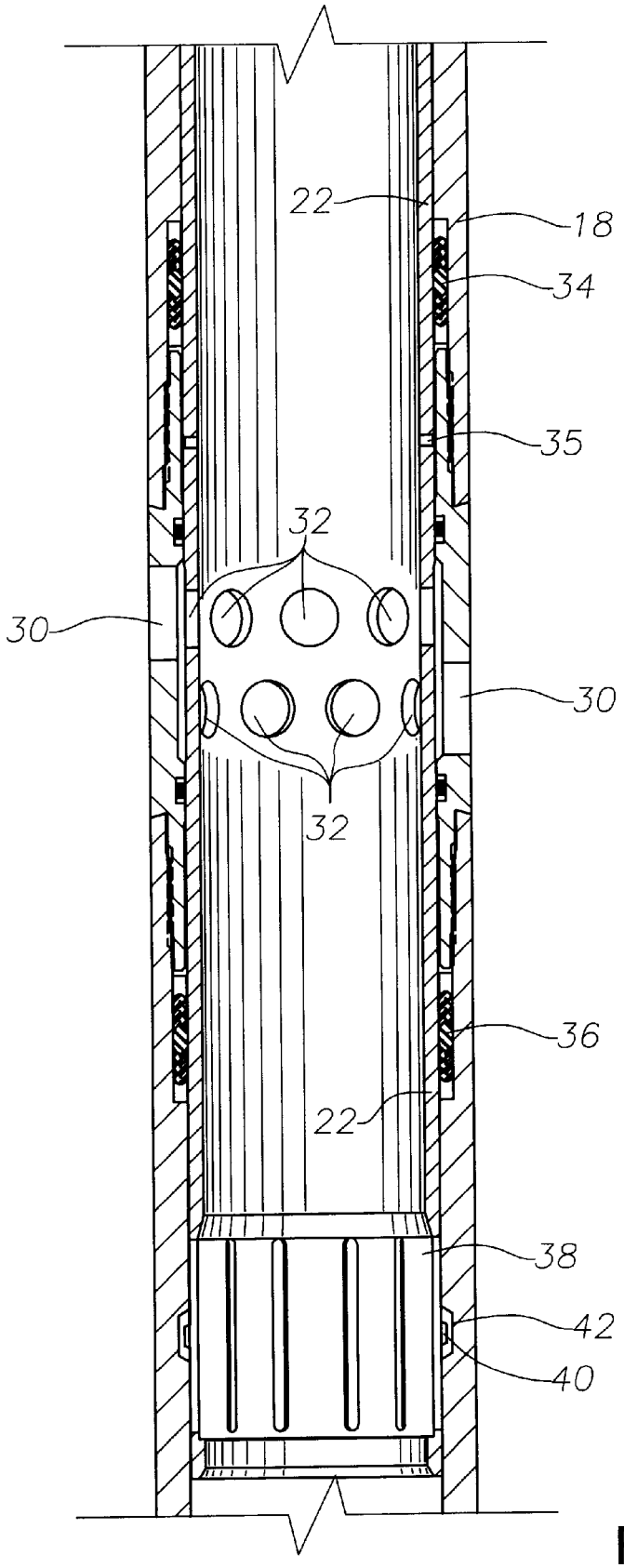

When it is desired to move the sliding sleeve 10 to its open position, as shown in FIG. 3A–3B, to establish fluid communication through the fluid flow ports 30 and 32, pressure is applied to the annulus 13, in any manner known to those of skill in the art. Referring to FIG. 2A, the annulus pressure is applied to the piston 24 through the at least one annulus pressure port 26. The annulus pressure is contained by the inner piston seal 24*c*, the outer lower piston seal 24*e*, and the upper annular fluid flow port seal 34, and acts upon the lower piston surface 24*b* to force the piston 24 and the inner sleeve 22 upwardly. The force applied to the lower piston surface 24*b* by the annulus pressure should be sufficient to (a) release the piston from the housing, for example, by shearing the at least one shear pin 25, and (b) disengage the collet rib 40 from the intermediate recess 44. Referring to FIG. 3A, the piston 24 and inner sleeve 22 cease upward movement when an upper surface 48 of the inner sleeve 22 abuts against an upper annular shoulder 50 within the longitudinal bore 20 of the housing 18. When the inner sleeve 22 is in this uppermost position, the sliding sleeve 10 of the present invention is in its open position. As shown in FIG. 3B, opening the sliding sleeve 10 brings the flow ports 30 and 32 into alignment and establishes fluid communication between the annulus 13 and the longitudinal bore 23 of the inner sleeve 22. Fluids from the production zone 16 may then be produced to the earth's surface through the tubular conduit 12. As shown in FIG. 3B, the collet rib 40 is located in the upper recess 42 when the sliding sleeve 10 is in its open position.

If it is desired to equalize the pressure between the annulus 13 and the longitudinal bore 23 of the inner sleeve 22—so as to avoid an initial rapid fluid flow through the flow ports 30 and 32 —the collet rib 40 may be moved into, and held in, the equalizing recess 43 prior to being moved into the upper recess 42. This will move the inner sleeve 22 up to a point so that fluid communication is established from the at least one outer flow port 30 through the at least one equalizing port 35 but is not established through the at least one inner flow port 32. After the pressure between the annulus 13 and the longitudinal bore 23 of the inner sleeve 22 is equalized through the at least one equalizing port 35, the inner sleeve 22 may then be moved upwardly until flow ports 30 and 32 are aligned, as more fully explained above.

Figure 4A:
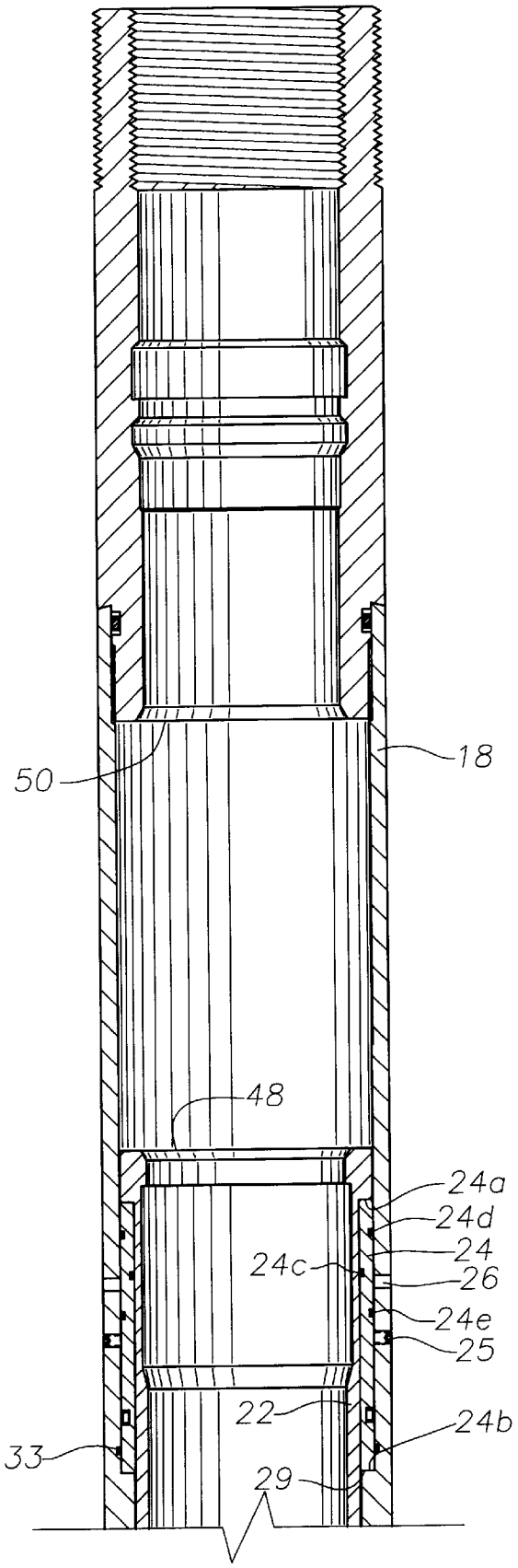
FIGS. 4A through 4C illustrate a partial cross-sectional elevation view which together show a sliding sleeve of the present invention in a closed position.
Figure 4B:
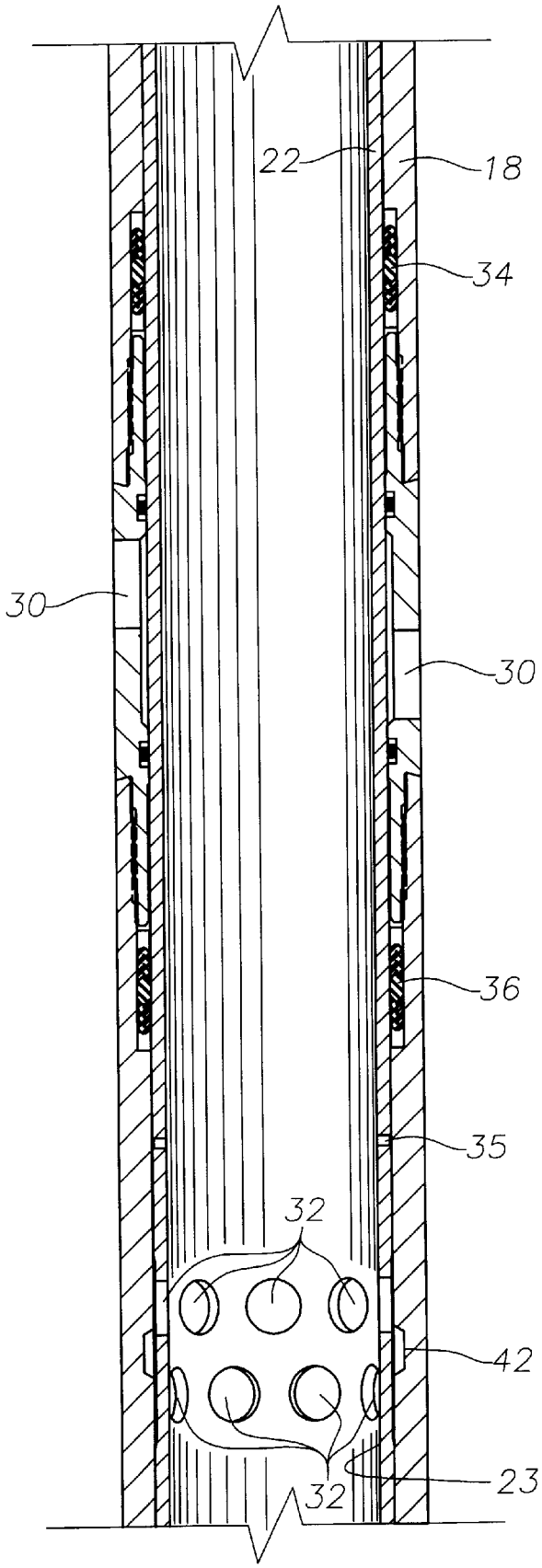
Figure 4C:
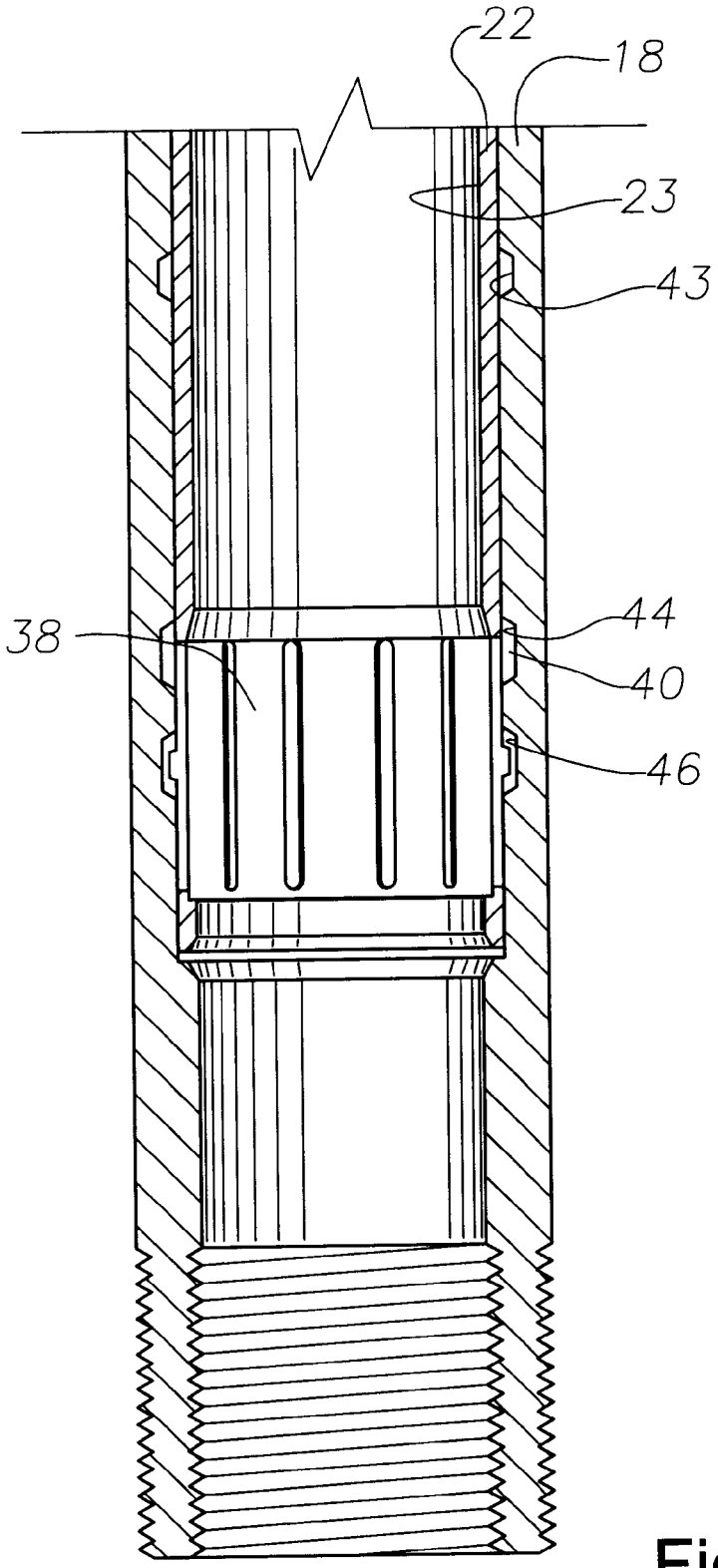

When it is desired to move the sliding sleeve 10 to its closed position, as shown in FIGS. 4A–4C, to stop the flow of fluids from the production zone 16, a wireline shifting tool (not shown) is used to apply a downward impact force to the inner sleeve 22, in a manner well known to those skilled in the art. Fluid communication through the ports 30 and 32 will be fully terminated when the at least one flow port 32 in the inner sleeve 22 is moved below the lower flow port seal 36. The sliding sleeve 10 will be fully closed, and the inner sleeve 22 will be in its lowermost position, when the collet rib 40 is located in the lower recess 46, as shown in FIG. 4C. With reference to FIG. 4A, when the sliding sleeve 10 is in its fully closed position, the lower surface 24*b* of the piston 24 is abutted against the annular shoulder 29 within the longitudinal bore 20 of the housing 18. In this position, the outer lower piston seal 24*e* is located below the at least one annulus pressure port 26 20 and the outer upper piston seal 24*d* is located above the at least one annulus pressure port 26. Thus, when the sliding sleeve 10 is in its fully closed position, the at least one annulus pressure port 26 is sealed off by piston seals 24*d* and 24*e*, and any leakage associated with the sheared shear pin 25 is prevented by housing seal 33. This locks out any further hydraulic actuation of the sliding sleeve 10. Any further actuation of the sliding sleeve 10 is restricted to actuation by the use of wireline tools, in a manner known to those skilled in the art.

Whereas the present invention has been described in particular relation to the drawings attached hereto, it should be understood that other and further modifications, apart from those shown or suggested herein, may be made within the scope and spirit of the present invention. For example, the annulus pressure could act to move a piston downwardly to move the inner sleeve downwardly to place the flow ports in fluid communication. Accordingly, the invention is therefore to be limited only by the scope of the appended claims.

What is claimed is:

1. A sliding sleeve connected to a tubular conduit disposed within a well conduit for controlling fluid flow through the tubular conduit, the tubular conduit and well conduit defining an annulus therebetween, the sliding sleeve comprising:

a housing having a longitudinal bore extending therethrough, at least one annulus pressure port, and at least one outer fluid flow port;

an inner sleeve disposed for axial movement within the longitudinal bore of the housing, and having a longitudinal bore and at least one inner fluid flow port for cooperating with the at least one outer fluid flow port through the housing to control fluid flow between the annulus and the longitudinal bore of the inner sleeve; and, a piston associated with the inner sleeve and the longitudinal bore of the housing;

the housing, inner sleeve, and piston cooperating to yield:

a run-in mode wherein the piston is releasably secured to the housing, the piston is exposed to annulus pressure through the at least one annulus pressure port, and the at least one outer fluid flow port is misaligned with the at least one inner fluid flow port so that fluid communication is prevented between the annulus and the longitudinal bore of the inner sleeve;

an opening mode wherein a predetermined annulus pressure is applied through the at least one annulus pressure port to the piston to release the piston from the housing and force the inner sleeve to a first position so that the at least one outer fluid flow port is aligned with the at least one inner fluid flow port and fluid communication is established between the annulus and the longitudinal bore of the inner sleeve; and, a closing mode wherein the inner sleeve is shifted to a second position so that the at least one outer fluid flow port is misaligned with the at least one inner fluid flow port so that fluid communication is prevented between the annulus and the longitudinal bore of the inner sleeve.

2. The sliding sleeve of claim 1, further including a collet attached to the inner sleeve and having an annular rib.

3. The sliding sleeve of claim 2, wherein the housing further includes at least one annular recess within its longitudinal bore for receiving the collet rib.

4. The sliding sleeve of claim 2, wherein:

the housing further includes within its longitudinal bore an upper annular recess, an intermediate annular recess, and a lower annular recess; and, the collet rib is located in the upper annular recess when the inner sleeve is in its first position, the collet rib is located in the intermediate annular recess when the inner sleeve is in the run-in mode, and the collet rib is located in the lower annular recess when the inner sleeve is in its second position.

5. The sliding sleeve of claim 4, wherein the predetermined annulus pressure is sufficient to release the piston from the housing and disengage the collet rib from the intermediate recess.

6. The sliding sleeve of claim 1, further including piston seal means for sealing the it piston from the at least one annulus pressure port so that the piston is no longer exposed to annulus pressure when the inner sleeve is in its second position.

7. The sliding sleeve of claim 6, wherein the piston seal means includes an outer upper annular piston seal and an outer lower annular piston seal, the outer annular seals being disposed between the piston and the housing, the outer upper annular seal being disposed above the at least one annulus pressure port when the inner sleeve is in its second position, and the outer lower annular seal being disposed below the at least one annulus pressure port when the inner sleeve is in its second position.

8. The sliding sleeve of claim 7, wherein the outer annular seals are disposed above the at least one annulus pressure port when the sliding sleeve is in its run-in mode.

9. The sliding sleeve of claim 1, wherein an upper surface of the piston is abutted against an upper shoulder of the inner sleeve when the sliding sleeve is in its run-in mode, and a lower surface of the piston is displaced above an annular shoulder within the longitudinal bore of the housing when the sliding sleeve is in its run-in mode.

10. The sliding sleeve of claim 1, wherein an upper surface of the piston is abutted against an upper shoulder of the inner sleeve when the inner sleeve is in its second position, and a lower surface of the piston is abutted against an annular shoulder within the longitudinal bore of the housing when the inner sleeve is in its second position.

11. The sliding sleeve of claim 1, wherein an upper surface of the inner sleeve is abutted against an upper annular shoulder within the longitudinal bore of the housing when the inner sleeve is in its first position.

12. The sliding sleeve of claim 1, further including an upper annular flow port seal and a lower annular flow port seal, the flow port seals being disposed between the inner sleeve and the housing, the upper annular flow port seal being disposed above the outer fluid flow port and the lower annular flow port seal being disposed below the outer fluid flow port.

13. The sliding sleeve of claim 12, wherein the flow port seals are chevron packing.

14. The sliding sleeve of claim 12, wherein fluid communication between the annulus and the longitudinal bore of the inner sleeve becomes sealably prevented upon the at least one inner fluid flow port in the inner sleeve passing below the lower annular flow port seal during transition from the opening mode to the closing mode.

15. The sliding sleeve of claim 1, further including an inner annular piston seal disposed between the inner sleeve and the piston, an outer annular piston seal disposed between the piston and the housing, and an upper annular flow port seal disposed above the outer fluid flow port and between the inner sleeve and the housing, whereby the inner annular piston seal, the outer annular piston seal, and the upper annular flow port seal cooperate to sealably apply annulus pressure to the piston.

16. The sliding sleeve of claim 1, wherein the piston is sealably disposed around the inner sleeve and within the longitudinal bore of the housing.

17. The sliding sleeve of claim 1, wherein the piston is shearably affixed by shear means to the housing during the run-in mode.

18. The sliding sleeve of claim 17, further including an annular housing seal disposed within the longitudinal bore of the housing beneath the shear means and above an annular shoulder within the housing to prevent any leakage associated with the shear means when the inner sleeve is in its second position.

19. The sliding sleeve of claim 4, wherein:

the inner sleeve further includes at least one equalizing port above the at least one inner fluid flow port;

the housing further includes within its longitudinal bore an equalizing recess between the upper recess and the intermediate recess; and the housing and inner sleeve cooperate to yield an equalizing mode wherein the collet rib is located in the equalizing recess, and pressure between the annulus and the longitudinal bore of the inner sleeve is equalized through the equalizing port and outer fluid flow port.

20. A sliding sleeve connected to a tubular conduit disposed within a well conduit for controlling fluid flow through the tubular conduit, the tubular conduit and well conduit defining an annulus therebetween, the sliding sleeve comprising:

a housing having a longitudinal bore extending therethrough, at least one annulus pressure port, and at least one outer fluid flow port, the longitudinal bore having an upper annular recess, an intermediate annular recess, and a lower annular recess;

an inner sleeve disposed for axial movement within the longitudinal bore of the housing, and having a longitudinal bore and at least one inner fluid flow port for cooperating with the at least one outer fluid flow port through the housing to control fluid flow between the annulus and the longitudinal bore of the inner sleeve;

a piston associated with the inner sleeve and the longitudinal bore of the housing;

a collet attached to the inner sleeve and having an annular rib;

the housing, inner sleeve, and piston cooperating to yield:

a run-in mode wherein the piston is releasably secured to the housing, the piston is exposed to annulus pressure through the at least one annulus pressure port, the at least one outer fluid flow port is misaligned with the at least one inner fluid flow port so that fluid communication is prevented between the annulus and the longitudinal bore of the inner sleeve, and the collet rib is located in the intermediate annular recess;

an opening mode wherein a predetermined annulus pressure is applied through the at least one annulus pressure port to the piston to release the piston from the housing, disengage the collet rib from the intermediate recess, and force the inner sleeve to a first position, so that the at least one outer fluid flow port is aligned with the at least one inner fluid flow port, fluid communication is established between the annulus and the longitudinal bore of the inner sleeve, and the collet rib is located in the upper annular recess; and, a closing mode wherein the inner sleeve is shifted to a second position so that the at least one outer fluid flow port is misaligned with the at least one inner fluid flow port, fluid communication is prevented between the annulus and the longitudinal bore of the inner sleeve, and the collet rib is located in the lower annular recess.

21. The sliding sleeve of claim 20, further including an outer upper annular piston seal and an outer lower annular piston seal, the outer annular seals being disposed between the piston and the housing, the outer upper annular seal being disposed above the at least one annulus pressure port when the inner sleeve is in its second position, and the outer lower annular seal being disposed below the at least one annulus pressure port when the inner sleeve is in its second position, the outer piston seals sealing the piston from the at least one annulus pressure port so that the piston is no longer exposed to annulus pressure when the inner sleeve is in its second position.

22. The sliding sleeve of claim 21, wherein the outer annular seals are disposed above the at least one annulus pressure port when the sliding sleeve is in its run-in mode.

23. The sliding sleeve of claim 20, wherein:

when the sliding sleeve is in its run-in mode, an upper surface of the piston is abutted against an upper shoulder of the inner sleeve, and a lower surface of the piston is displaced above an annular shoulder within the longitudinal bore of the housing;

when the inner sleeve is in its second position, the upper surface of the piston is abutted against the upper shoulder of the inner sleeve, and the lower surface of the piston is abutted against the annular shoulder within the longitudinal bore of the housing; and, when the inner sleeve is in its second position, an upper surface of the inner sleeve is abutted against an upper annular shoulder within the longitudinal bore of the housing.

24. The sliding sleeve of claim 20, further including an upper annular flow port seal and a lower annular flow port seal, the flow port seals being disposed between the inner sleeve and the housing, the upper annular flow port seal being disposed above the outer fluid flow port and the lower annular flow port seal being disposed below the outer fluid flow port.

25. The sliding sleeve of claim 24, wherein the flow port seals are chevron packing.

26. The sliding sleeve of claim 24, wherein fluid communication between the annulus and the longitudinal bore of the inner sleeve becomes sealably prevented upon the at least one inner fluid flow port in the inner sleeve passing below the lower annular flow port seal during transition from the opening mode to the closing mode.

27. The sliding sleeve of claim 20, further including an inner annular piston seal disposed between the inner sleeve and the piston, an outer lower annular piston seal disposed between the piston and the housing, and an upper annular flow port seal disposed above the outer fluid flow port and between the inner sleeve and the housing, whereby the inner annular piston seal, the outer lower annular piston seal, and the upper annular flow port seal cooperate to sealably apply annulus pressure to the piston.

28. The sliding sleeve of claim 20, wherein the piston is sealably disposed around the inner sleeve and within the longitudinal bore of the housing.

29. The sliding sleeve of claim 20, wherein the piston is shearably affixed by shear means to the housing during the run-in mode.

30. The sliding sleeve of claim 29, further including an annular housing seal disposed within the longitudinal bore of the housing beneath the shear means and above an annular shoulder within the housing to prevent any leakage associated with the shear means when the inner sleeve is in its second position.

31. The sliding sleeve of claim 20, wherein:

the inner sleeve further includes at least one equalizing port above the at least one inner fluid flow port;

the housing further includes within its longitudinal bore an equalizing recess between the upper recess and the intermediate recess; and the housing and inner sleeve cooperate to yield an equalizing mode wherein the collet rib is located in the equalizing recess, and pressure between the annulus and the longitudinal bore of the inner sleeve is equalized through the equalizing port and outer fluid flow port.

32. A sliding sleeve connected to a tubular conduit disposed within a well conduit for controlling fluid flow through the tubular conduit, the tubular conduit and well conduit defining an annulus therebetween, the sliding sleeve comprising:

a housing having a longitudinal bore extending therethrough, at least one annulus pressure port, and at least one outer fluid flow port;

an inner sleeve disposed for axial movement within the longitudinal bore of the housing, and having a longitudinal bore and at least one inner fluid flow port for cooperating with the at least one outer fluid flow port through the housing to control fluid flow between the annulus and the longitudinal bore of the inner sleeve; and, a piston associated with the inner sleeve and the longitudinal bore of the housing;

the housing, inner sleeve, and piston cooperating to yield:

a run-in mode wherein the piston is exposed to annulus pressure through the at least one annulus pressure port, and the at least one outer fluid flow port is misaligned with the at least one inner fluid flow port so that fluid communication is prevented between the annulus and the longitudinal bore of the inner sleeve;

an opening mode wherein a predetermined annulus pressure is applied through the at least one annulus pressure port to the piston to force the inner sleeve to a first position so that the at least one outer fluid flow port is aligned with the at least one inner fluid flow port and fluid communication is established between the annulus and the longitudinal bore of the inner sleeve; and, a closing mode wherein the inner sleeve is shifted to a second position so that the at least one outer fluid flow port is misaligned with the at least one inner fluid flow port so that fluid communication is prevented between the annulus and the longitudinal bore of the inner sleeve.

33. The sliding sleeve of claim 32, wherein the piston is releasably secured to the housing during the run-in mode, and the predetermined annulus pressure releases the piston from the housing during the opening mode.

34. The sliding sleeve of claim 32, further including a collet attached to the inner sleeve and having an annular rib.

35. The sliding sleeve of claim 34, wherein the housing further includes at least one annular recess within its longitudinal bore for receiving the collet rib.

36. The sliding sleeve of claim 34, wherein:

the housing further includes within its longitudinal bore an upper annular recess, an intermediate annular recess, and a lower annular recess; and, the collet rib is located in the upper annular recess when the inner sleeve is in its first position, the collet rib is located in the intermediate annular recess when the inner sleeve is in the run-in mode, and the collet rib is located in the lower annular recess when the inner sleeve is in its second position.

37. The sliding sleeve of claim 36, wherein the predetermined annulus pressure is sufficient to disengage the collet rib from the intermediate recess during the run-in mode.

38. The sliding sleeve of claim 32, further including piston seal means for sealing the piston from the at least one annulus pressure port so that the piston is no longer exposed to annulus pressure when the inner sleeve is in its second position.

39. The sliding sleeve of claim 38, wherein the piston seal means includes an outer upper annular piston seal and an outer lower annular piston seal, the outer annular seals being disposed between the piston and the housing, the outer upper annular seal being disposed above the at least one annulus pressure port when the inner sleeve is in its second position, and the outer lower annular seal being disposed below the at least one annulus pressure port when the inner sleeve is in its second position.

40. The sliding sleeve of claim 39, wherein the outer annular seals are disposed above the at least one annulus pressure port when the sliding sleeve is in its run-in mode.

41. The sliding sleeve of claim 32, wherein an upper surface of the piston is abutted against an upper shoulder of the inner sleeve when the sliding sleeve is in its run-in mode, and a lower surface of the piston is displaced above an annular shoulder within the longitudinal bore of the housing when the sliding sleeve is in its run-in mode.

42. The sliding sleeve of claim 32, wherein an upper surface of the piston is abutted against an upper shoulder of the inner sleeve when the inner sleeve is in its second position, and a lower surface of the piston is abutted against an annular shoulder within the longitudinal bore of the housing when the inner sleeve is in its second position.

43. The sliding sleeve of claim 32, wherein an upper surface of the inner sleeve is abutted against an upper annular shoulder within the longitudinal bore of the housing when the inner sleeve is in its first position.

44. The sliding sleeve of claim 32, further including an upper annular flow port seal and a lower annular flow port seal, the flow port seals being disposed between the inner sleeve and the housing, the upper annular flow port seal being disposed above the outer fluid flow port and the lower annular flow port seal being disposed below the outer fluid flow port.

45. The sliding sleeve of claim 44, wherein the flow port seals are chevron packing.

46. The sliding sleeve of claim 44, wherein fluid communication between the annulus and the longitudinal bore of the inner sleeve becomes sealably prevented upon the at least one inner fluid flow port in the inner sleeve passing below the lower annular flow port seal during transition from the opening mode to the closing mode.

47. The sliding sleeve of claim 32, further including an inner annular piston seal disposed between the inner sleeve and the piston, an outer annular piston seal disposed between the piston and the housing, and an upper annular flow port seal disposed above the outer fluid flow port and between the inner sleeve and the housing, whereby the inner annular piston seal, the outer annular piston seal, and the upper annular flow port seal cooperate to sealably apply annulus pressure to the piston.

48. The sliding sleeve of claim 32, wherein the piston is sealably disposed around the inner sleeve and within the longitudinal bore of the housing.

49. The sliding sleeve of claim 32, wherein the piston is shearably affixed by shear means to the housing during the run-in mode.

50. The sliding sleeve of claim 49, further including an annular housing seal disposed within the longitudinal bore of the housing beneath the shear means and above an annular shoulder within the housing to prevent any leakage associated with the shear means when the inner sleeve is in its second position.

51. The sliding sleeve of claim 36, wherein:

the inner sleeve further includes at least one equalizing port above the at least one inner fluid flow port;

the housing further includes within its longitudinal bore an equalizing recess between the upper recess and the intermediate recess; and the housing and inner sleeve cooperate to yield an equalizing mode wherein the collet rib is located in the equalizing recess, and pressure between the annulus and the longitudinal bore of the inner sleeve is equalized through the equalizing port and outer fluid flow port.

* * * * *